US007303597B2

(12) United States Patent
Sprouse et al.

(10) Patent No.: US 7,303,597 B2
(45) Date of Patent: Dec. 4, 2007

(54) METHOD AND APPARATUS FOR CONTINUOUSLY FEEDING AND PRESSURIZING A SOLID MATERIAL INTO A HIGH PRESSURE SYSTEM

(75) Inventors: Kenneth Michael Sprouse, Northridge, CA (US); David R Matthews, Simi Valley, CA (US); Albert E Stewart, Sylmar, CA (US)

(73) Assignee: Pratt & Whitney Rocketdyne, Inc., Canoga Park, CA (US)

( * ) Notice: Subject to any disclaimer, the term of this patent is extended or adjusted under 35 U.S.C. 154(b) by 792 days.

(21) Appl. No.: 10/271,950

(22) Filed: Oct. 15, 2002

(65) Prior Publication Data

US 2004/0071618 A1 Apr. 15, 2004

(51) Int. Cl.
*C01B 3/36* (2006.01)

(52) U.S. Cl. ..... 48/197 R; 406/99; 406/197

(58) Field of Classification Search ..... 406/197, 406/99, 197 R

See application file for complete search history.

(56) References Cited

U.S. PATENT DOCUMENTS

| | | | | |
|---|---|---|---|---|
| 3,856,658 | A | 12/1974 | Wolk et al. | |
| 4,191,500 | A | 3/1980 | Oberg et al. | |
| 4,197,092 | A | 4/1980 | Bretz | |
| 4,206,610 | A | 6/1980 | Santhanam | |
| 4,218,222 | A * | 8/1980 | Nolan et al. | 48/202 |
| 4,356,078 | A | 10/1982 | Heavin et al. | |
| 4,377,356 | A * | 3/1983 | Santhanam | 406/109 |
| 4,391,561 | A | 7/1983 | Smith et al. | |
| 4,433,947 | A * | 2/1984 | Kratzer et al. | 406/99 |
| 4,488,838 | A * | 12/1984 | Herud | 406/56 |
| 4,721,420 | A | 1/1988 | Santhanam et al. | |
| 4,765,781 | A * | 8/1988 | Wilks et al. | 406/197 |
| 5,273,556 | A * | 12/1993 | McMahon et al. | 48/197 R |
| 5,558,473 | A | 9/1996 | Lindahl | |
| 6,152,668 | A | 11/2000 | Knoch | |
| 6,220,790 | B1 | 4/2001 | Schenk et al. | |

FOREIGN PATENT DOCUMENTS

| | | |
|---|---|---|
| GB | 2002025 | * 2/1979 |
| JP | 06-287567 | * 10/1994 |

OTHER PUBLICATIONS

K. M. Sprouse and M. D. Schuman, Dense-Phase Feeding of Pulverized Coal in Uniform Plug Flow, Nov. 1983, pp. 1000-1006 and reference page.

* cited by examiner

*Primary Examiner*—N. Bhat
(74) *Attorney, Agent, or Firm*—Carlson, Gaskey & Olds

(57) ABSTRACT

A system for substantially continuously providing a solid material, for example pulverized coal, to a pressurized container. The system provides the solid material to a first container of a first pressure elevated above an initial pressure of the solid material. Generally, a screw conveyor augmented with a jet port is used to move the material where the jet port provides a gas to provide a make-up volume of the solid material. The system also provides the material to a second high pressure container after the material has been formed into a slurry. Therefore, the solid material may be substantially continuously provided in a system to a high pressure container.

22 Claims, 4 Drawing Sheets

METHOD AND APPARATUS FOR CONTINUOUSLY FEEDING AND PRESSURIZING A SOLID MATERIAL INTO A HIGH PRESSURE SYSTEM

FIELD OF THE INVENTION

The present invention relates to moving coal to a high pressure system, and more particularly to continuously feeding coal from a low pressure to a high pressure system for processing of the coal.

BACKGROUND OF THE INVENTION

The apparatus used in present day power generation systems typically require a high pressure coal supply system. In particular, many of these high pressure systems include high pressure reactors which combust the coal to produce heat or to further refine the carbon from the coal. The high pressure is used to nearly instantaneously combust the coal to produce the desired energy release. Coal, even when highly pulverized, is substantially a solid material and difficult to pressurize to the high pressures needed for combustion. To assist in providing the coal and achieving the high pressures required for combustion thereof, the coal is often formed into a slurry. The slurry then can be more easily pumped and pressurized to the required high pressures. Generally, it is desired to have the coal pressurized to at least 1000 psig.

Various systems have been developed to provide the high pressure coal required, but these systems all have numerous inefficiencies. With such systems, coal is generally first placed into a slurry of some form. The slurry includes a liquid, such as water, with the coal particles suspended therein. The carrier fluid of the slurry is also provided to the reactor as a large surplus in the slurry, thereby decreasing the efficiency of the reactor.

One specific, previously developed system is a lock hopper feeder system. With this type of system, the hoppers are first pressurized and then emptied into the pressurized system. After the first hopper is emptied the system is closed, then a second hopper is pressurized, and then emptied into the pressurized system. This system provides only a substantially discontinuous feed of the pressurized coal.

Other systems have been proposed which produce a liquid carbon dioxide and coal slurring which is then fed into the combustion or reaction system. Nevertheless, these systems still require the unreliable cycling lock hoppers to initially increase the pressure of the slurry. Moreover, the cycling lock hoppers generally include multiple valves and gas compressors that are inefficient and require nearly constant maintenance.

Still other systems have attempted to provide a feeder system which uses a screw feeder or pump, but has similar disadvantages. In particular, they generally require a plurality of heat exchangers around the feeder itself to provide the proper temperature of the carbon dioxide ($CO_2$) that is fed into the coal in the feeder. These rely upon the solidification of the liquid $CO_2$ pumped into the feeder to provide a seal to stop the backflow of the material as it goes from the low pressure input to the high pressure output. These systems do not easily overcome the high pressure head against which the coal is pumped.

Therefore, it is desired to provide a system that will allow for a continuous feed of coal into a high pressure coal system for gasification and other high pressure systems. In particular, it is desired to provide a continuous coal feed system which can use relatively inexpensive $CO_2$ gas for delivering the coal to the combustor at ambient temperature at its static bed bulk density. Also, it is desired to provide a system that can provide the high pressure coal slurring through no more than two holding tanks, to thereby provide a high pressure supply tank for the high pressure reactors.

SUMMARY OF THE INVENTION

The present invention relates to a system for a continuous feed of coal into a high pressure container. The continuous coal feed system first provides an initial pressurization of the solid coal that is provided into a first pressure tank. A slurry is formed in the first pressure tank including carbon dioxide liquid that is then pressurized through a second slurry pump to the final high pressure storage tank.

A first preferred embodiment of the present invention forms a system to substantially continuously pressurize a material. The system includes a container that contains a supply of the material at a first pressure. A feeder has a feeder inlet that is operably interconnected with the container such that a portion of the material is adapted to be selectively and continuously supplied to the feeder. The feeder also has a feeder outlet so that a tank, at a second pressure, has a tank inlet operably interconnected with the feeder outlet. The second pressure is at least twice the first pressure and the feeder selectively and substantially continuously transports the material from the container to the tank.

A second preferred embodiment of the present invention comprises a system to substantially continuously pressurize a material and provide the pressurized material to a high pressure reactor. The system includes a container to contain a supply of the material at an ambient pressure. A feeder that has a feeder inlet is operably interconnected with the container such that a portion of the material is adapted to be selectively and continuously supplied to the feeder. A feed assistor is disposed in the feeder to assist in feeding the material toward a feeder outlet. A first tank held at a pressure at least twice as great as the ambient pressure of the container, also has a tank inlet operably interconnected with the feeder outlet. The feeder selectively and substantially continuously transports the material from the container to the first tank.

A third preferred embodiment of the present invention provides a system to substantially continuously provide a pressurized coal slurry to a pressurized holding tank. The system has a receptacle to supply the coal at an ambient pressure to a receptacle outlet. Also included is a feeder that has a feeder inlet operably connected with the receptacle outlet such that a portion of the coal is adapted to be selectively and continuously supplied to the feeder. A slurry tank holds a slurry of the coal and a liquid at a pressure at least twice as great as the ambient pressure of the container. The tank also has a tank inlet operably connected to a feeder outlet. A slurry pump pumps the slurry from the slurry tank to a high pressure tank. The slurry pump increases the pressure of the slurry by at least four times.

A fourth preferred embodiment of the present invention comprises a method of substantially continuously providing a pressurized slurry of a solid material and a liquid to a high pressure system. The method includes transporting an amount of the material being held dry and at an ambient pressure to a pressurized container with a feeder. The material is then mixed in the pressure container with a liquid to form a slurry. Next, the slurry is pumped to a high pressure container from the pressure container. Also, a portion of the liquid is removed from the slurry before the slurry enters the high pressure container.

A fifth preferred embodiment of the present invention comprises a jet feeder to transport a pulverized material from a low pressure to a high pressure environment. The jet feeder has a housing to contain the material while it is within the jet feeder. The housing defines an inlet port to receive the pulverized material. An outlet port allows the material to exit the housing. A screw is disposed within the housing to advance the material from the inlet port to the outlet port. A jet port is defined on the screw. The jet port assists in moving the material to the outlet port. The pressure at the outlet port is higher than a pressure at the inlet port.

A sixth preferred embodiment of the present invention comprises a jet feeder to transport a pulverized material from a low pressure to a high pressure environment. A housing of the jet feeder contains the material while it is within the jet feeder. The housing also defines an inlet port and an outlet port. A screw is disposed within the housing to advance the material from the inlet port to the outlet port, and adapted to rotate axially in a first direction. A labyrinth seal is formed around and in communication with the screw to substantially eliminate reverse movement of the material. The pressure at the outlet port is higher than a pressure at the inlet port.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiment(s) is merely exemplary in nature and is in no way intended to limit the invention, its application, or uses.

Figure 1:
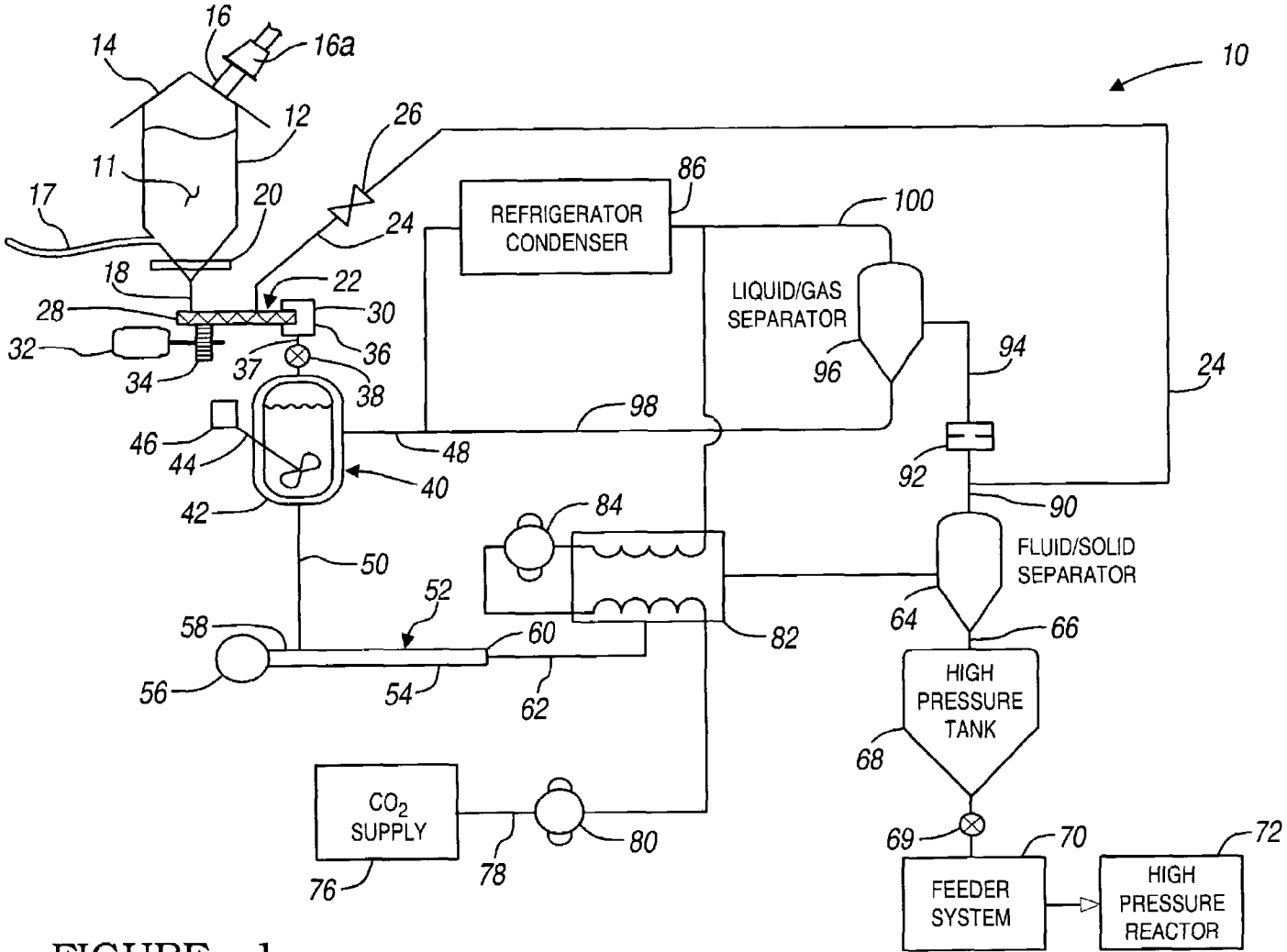
FIG. 1 is a diagrammatic view of a continuous coal feed system for supplying pulverized coal into a high pressure container, according to a preferred embodiment of the present invention.

With reference to FIG. 1, a continuous pulverized coal feed system 10 in accordance with a preferred embodiment of the present invention is illustrated. A volume of pulverized coal 11 is first held in an ambient coal silo 12. The coal silo 12 is capped with an appropriate cover 14 which includes a feed line 16. The feed line 16 may include a feed device 16*a*, such as a vibrator feeder, to encourage the flow of the coal into the storage silo 12. A carbon dioxide ($CO_2$) purge line 17 provides a flow of $CO_2$ through the coal 11 to purge atmospheric air trapped in the interstitial spaces between particles of the coal 11. The coal silo 12 includes an exit or emptying port 18. The coal 11 is coaxed or removed from the storage silo 12 through the emptying port 18 using a shaker or agitator 20. This moves the coal from inside the silo 12, or a portion near the exit port 18, to cause the coal to continuously feed into a solid coal pump 22.

The solid coal pump 22 is required to pump against a pressure head of the least about 60 pounds per square inch gage (psig) (about 5.1 atmospheres). In addition, it may be desirable to have the solid coal pump 22 pump the solid coal from the coal silo 12 against a pressure of at least about 150 psig (about 11.2 atmospheres). To perform such a task, the solid coal pump 22 may include a gaseous feeder line 24 with a check valve 26 to regulate the flow of a gas through the gas feeder line 24. The solid coal pump 22 includes an atmospheric or ambient pressure or inlet side 28 and a high pressure or outlet side 30.

The solid coal pump 22 is generally operated by a motor 32 interconnected with the solid coal pump 22 by an appropriate gear box 34. The coal from the coal silo 12 enters the pump 22 at the low pressure end 28. The solid coal pump 22 then pumps the coal 11 along the length of the solid coal pump 22 to the outlet side 30. During this time, the coal 11 increases in pressure and exits the pump 22 at the appropriate elevated pressure.

At the outlet side 30, the coal 11 is first collected in a collection stop 36. A line 37 includes a valve 38 that can be used to control the flow of the coal 11 from the coal collection stop 36 to a coal slurry tank 40. The coal slurry tank 40 may include an insulated jacket 42 so that the contents of the coal tank 40 may be kept at a constant temperature. Moreover, the jacket 42 may include a refrigeration or heating unit to further regulate the temperature of the coal slurry tank 40. The coal slurry tank 40 also includes an appropriate agitator 44 such as a rotor or blade agitator. The agitator 44 is powered by an appropriate external or internal motor 46 to provide the agitation necessary to keep the slurry in the slurry tank 40 in suspension.

The slurry formed in the slurry tank 40 has a solid or substantially solid component, including solid coal 11 fed to the slurry tank 40 from the storage silo 12. The solid component is suspended in a liquid component, which may be any appropriate liquid component, but is generally a liquid carbon dioxide which is supplied to the slurry tank 40 from a slurry agent, preferably liquid carbon dioxide, line 48. The liquid $CO_2$ is provided through the slurry agent line 48 to the slurry tank 40 where the agitator 44 agitates the solid coal 11 to keep the solid coal 11 suspended in the liquid $CO_2$. Generally, the tank is kept at a pressure of at least about 60 psig to keep the $CO_2$ in a liquid state. Therefore, the temperature of the slurry tank 40 is about minus 36° C. to about minus 55° C. (about minus 33° F. to about minus 67° F.).

The slurry exits the slurry tank 40 through a slurry line 50 to a liquid slurry pump 52. The liquid slurry pump 52 can be any generally known liquid slurry pump such as a pump produced by Moyno Inc. of Springfield, Ohio. The liquid slurry pump 52 includes a pump portion or section 54 which is driven by a motor 56. The liquid slurry pump 52 also includes a low pressure inlet 58 and a high pressure outlet 60. The high pressure outlet 60 includes a exit line or slurry feed line 62. The slurry feed line 62 feeds the slurry from the liquid slurry pump 52 to a fluid/solid separator 64. The liquid slurry pump 52 increases the pressure of the slurry from the pressure which exits the slurry tank 40 to about 1300 psig. It will be understood that lower or higher pressures may be obtained depending upon the desired final pressure. In addition, several liquid slurry pumps 52 may be placed in succession to increase or ramp up the pressure of the liquid slurry.

The fluid/solid separator 64 may include a separator such as a cyclone type separator. The fluid/solid separator 64 provides a mechanism to remove the excess fluid from the slurry before the slurry is provided to a high pressure tank line 66 to be stored in a high pressure feed tank 68. The fluid/solid separator 64 is held at the pressure of the high pressure feed tank 68 which is the pressure which it exits the liquid slurry pump 52. Generally, the high pressure feed tank 68 is pressurized to at least about 1100 psig. The material pressurized in the high pressure feed tank 68 may then transported from the feed tank 68 with a feeder system 70 to an appropriate high pressure reactor 72. An appropriate feeder system 70 is described in U.S. Pat. No. 4,191,500 to Oberg et al. and originally assigned to Rockwell International Corporation entitled "Dense-Phase Feeder Method," the entire disclosure which is hereby incorporated by reference. Therefore, the material stored in the high pressure feed tank 68 can be efficiently and easily transported to the high pressure reactor 72 for reaction.

Thus far, the description of the system 10 has described the path of the solid coal from the coal silo 12 that becomes a slurry in the slurry tank 40, and then pumped under high pressure to the high pressure feed tank 68. The solid coal pump 22 and the slurry tank 40, however, each may require an additional material for assistance in their operation. Although the following description describes a gas being provided to the solid coal pump 22, it will be understood that a pump that is able to pump the solid coal from the atmospheric pressure of the coal silo 12 to the pressure of the slurry tank 40 may be used in the present system 10. Nevertheless, the liquid used to form the slurry in the slurry tank 40 and the gas provided to the solid coal pump 22 is preferably $CO_2$.

The $CO_2$ is initially provided from a $CO_2$ supply 76. After initialization of the system 10, however, much of the $CO_2$ is recycled. Therefore, the $CO_2$ supply 76 becomes a make-up $CO_2$ supply 76. The makeup $CO_2$ supply 76 is generally held at ambient conditions which are generally around one atmosphere (0.0 psig) and at about 21° C. (70° F.), such that the $CO_2$ in the makeup supply 76 is a gas. The $CO_2$ is transported through the makeup supply line 78 where it encounters a first compressor 80. The first compressor 80 compresses the $CO_2$ from the $CO_2$ supply 76 to a pressure of about 60 psig. In addition, the first compressor 80 may increase the temperature of the $CO_2$ from the $CO_2$ supply 76 to a temperature of about 150° C. (about 300° F.).

The $CO_2$ line 78 then carries the $CO_2$ from the $CO_2$ supply 76 to a heat exchanger 82. The heat exchanger 82 transfers a portion of the thermal energy from the $CO_2$ in the $CO_2$ supply line 78 to the slurry transport line 62. The slurry in the slurry transport line 62 is at about minus 29° C. (about minus 20° F.). Therefore, it is desirable to increase the temperature of the slurry before it enters the fluid/solid separator 64 to about 21° C. Therefore, the heat exchanger 82 allows the slurry in the slurry transport line 62 to be heated to about 21° C. This in turn decreases the temperature of the $CO_2$ in the $CO_2$ supply line 78 to approximately 21° C. before it enters a second compressor 84. The second compressor 84 compresses the $CO_2$ to a pressure over about 150 psig and a temperature of approximately 150° C. (about 300° F.).

The $CO_2$ supply line 78 is again returned to the heat exchanger 82 to decrease the $CO_2$ temperature back to about 21° C. before it enters a refrigeration condenser unit 86. In the refrigeration and condenser unit 86 the $CO_2$, which originally came from the $CO_2$ supply 76, is cooled and condensed to a liquid form. The pressure of the $CO_2$ after it leaves the second compressor 84 is above the pressure of the slurry tank 40. The refrigeration condenser cools the $CO_2$ to approximately minus 40° C. (minus 40° F.) producing liquid $CO_2$. The liquid $CO_2$ is then delivered to the slurry tank 40 at the appropriate temperature and pressure to form a slurry in the slurry tank 40 with the solid coal 11 which has been pumped to the slurry tank 40 with the solid coal pump 22.

Excess $CO_2$ is removed from the slurry in the fluid/solid separator 64 and is returned to the system 10 through a $CO_2$ return or recycle line 90. The gas feed line 24 branches off of the $CO_2$ return line 90 to provide a high pressure carbon dioxide to the solid coal pump 22. The $CO_2$ that is separated in the fluid/solid separator 64 is still at a substantially elevated pressure, that is, the pressure that the slurry exited the liquid slurry pump 52. The $CO_2$, however, has been warmed due to the heat exchanger 82 so that the temperature of the $CO_2$ is approximately 21° C. in the solid coal feeder line 24.

The remaining $CO_2$, that is not directed to the solid coal pump 22 then travels to an expansion valve 92 where it is substantially reduced in pressure from the elevated pressure in the return line 90. The $CO_2$ exits the expansion valve into a low pressure return line 94 at a pressure of about 70 psig to about 180 psig. This drastic reduction in pressure also greatly reduces the temperature of the $CO_2$ so that the $CO_2$, when it is in the low pressure return line 94, is at a temperature of about minus 40° C. to about minus 57° C. (about minus 40° F. to about minus 70° F.). Also, at this point, the $CO_2$ is within the phase dome and exists in both a gas and a liquid phase. Therefore, the $CO_2$ is first delivered to a gas liquid separator 96 from the low pressure return line 94.

In the gas liquid separator 96, using an appropriate gas liquid cyclone separator, the gas liquid separator 96 withdraws the liquid portion of the $CO_2$ and transfers it to a liquid $CO_2$ return line 98. The liquid is returned to the slurry agent feed line 48 to provide liquid to the slurry tank 40. A gas $CO_2$ line 100 combines with the $CO_2$ from the $CO_2$ supply 76 and is provided to the refrigeration condenser 86. After the gas from the gas/liquid separator 96 is cooled, along with the gas $CO_2$ from the $CO_2$ supply 76, the condensed $CO_2$ is combined into the slurry agent feed line 48 to be provided to the slurry tank 40 to form the slurry.

Now that the system 10 has been described, the following is a discussion of the operation of the system 10 according to a preferred method of operation of the invention. The coal 11 provided to the coal silo 12 is generally first dried to preferably approximately 2 to about 6 weight percent moisture. Therefore, the coal 11 is substantially dry before it enters the coal silo 12. This reduces the amount of moisture and water vapor which must later be moved from the system 10 to ensure the proper operation of the system 10 and an efficient operation of the high pressure reactor 72. Moreover, the coal 11 that is provided into the coal silo 12 is generally pulverized to a very fine material. Generally, the coal 11 is pulverized such that about 70 to about 90 percent of the coal 11 passes through a 200 screen mesh. This is done not only to provide for an efficient operation of the solid coal pump 22 and the liquid slurry pump 52, but also so that the coal 11 may be quickly reacted in the high pressure reactor 72 after it is pressurized using this system 10. Although the coal 11 in the silo 12 is a very finely ground or pulverized, the coal 11 is still substantially a solid and is generally formed into a slurry pressurized in the continuous feed system 10 and provided to the high pressure feeder tank 68. Moreover, the silo 12 is generally kept at ambient or atmospheric conditions. Therefore, the silo 12 is generally not pressurized and kept at about one atmosphere and about 18 to 25° C. depending upon the ambient conditions. The coal in the coal silo 12 is generally both agitated and purged with $CO_2$ from the $CO_2$ purge line 17. In addition, this helps reduce the amount of moisture trapped in the coal particles 11 which are stored in the coal silo 12.

The coal 11 from the coal silo 12 is fed to the solid coal pump 22 under the power of gravity. Although the agitator 20 may be provided to assist in this process, generally the coal simply falls through the exit port 18 into the low pressure end or inlet 28 of the solid coal pump 22. The solid coal pump 22 then moves the coal 11 to the high pressure end 30 which increases the pressure of the coal 11 before it exits to the high pressure end 30.

As the coal 11 is pumped through the solid coal pump 22, the pressure of the solid coal 11 increases from the ambient, or about 0.0 psig, to the pressure of the slurry tank 40 which is generally about 60 psig to about 180 psig. This greatly compresses the $CO_2$ gas and any other interstitial gases which may be present between the solid coal particles 11. This compression decreases the volume of the coal particles 11 transport gas as it moves through the solid coal pump 22 by about 7 to about 10 times. The $CO_2$ gas provided through the $CO_2$ line 24 allows for a makeup of this compression volume so that inter-coal particle compression contact forces are minimized.

Without the make-up volume of $CO_2$ provided through the gas feeder line 24, the coal 11 will not flow through pump 22 and may become plugged. Due to the $CO_2$ provided to the solid coal pump 22, the solids bulk density of the coal 11 pumped through the solid coal pump 22 is generally not increased by more than about 5%. The coal particles enter the solids pump 22 at a bulk density of about 40 $lbm/ft^3$, because the coal 11 is pulverized, the true solids density of coal is about 87 $lbm/ft^3$. Therefore, the coal particles 11 do not become substantially compressed and remain generally movable through the solid coal pump 22. The $CO_2$ provided in the gas feeder line 24 to the solid coal pump 22 assist in allowing for a continuous operation of the solid coal pump 22 without overly compressing the coal 11 as it is pumped to the higher pressure tank 68.

After the coal 11 exits the high pressure end 30 it falls via gravity or by positive pumping directly into a slurry feed tank line 37. The slurry tank 40 includes the solid coal that has been pumped from the solid coal pump 22 and the liquid carbon dioxide provided by the slurry line 48. The slurry tank 40 is generally held at between about minus 34° C. to about minus 50° C. (about minus 30° F. to about minus 60° F.). This is one reason for the insulator lining 42 surrounding the slurry tank 40. If the $CO_2$ were to increase in temperature, then the pressure of the slurry tank 40 must be increased in order to maintain the $CO_2$ in the liquid phase. As an example, if the temperature were at about −30° C., the pressure of the slurry tank would be closer to about 180 psig. If the slurry tank 40 were at such an elevated temperature, then the solid coal pump 22 would be required to pump the solid coal 11 against such a pressure. Nevertheless, allowing the $CO_2$ to be of a higher temperature would allow for more efficient operation of the system 10 by reducing the amount of energy needed to heat the slurry. Also, not requiring additional refrigerators or condensers to cool the $CO_2$ to the lower temperatures would increase the efficiency by decreasing the amount of power needed to perform refrigeration. Nevertheless, an exemplary pump which may be used as the solid coal pump 22 to pump the solid coal against such a high pressure head is described further herein.

The slurry from the slurry tank 40 is then allowed to exit through the slurry transport line 50 to the liquid slurry pump 52. The pump 52 pumps the slurry to a pressure of preferably about 1100 psig to about 1400 psig. Although it is understood that these are merely exemplary pressures and the pressure to which the slurry may be finally pumped depends upon the pump used and the selected pressure requirements for the high pressure reactor 72.

After the high pressure slurry leaves the liquid slurry pump 52 it encounters the heat exchanger 82. The heat exchanger 82 transfers thermal energy from the $CO_2$ gas, provided from the $CO_2$ supply 76 to heat the slurry pumped through the slurry transport line 62 to about 20° C. Therefore, the heat exchanger 82 not only provides a way to heat the slurry transported in the slurry transport line 62, but also provides an inter-stage cooler for the $CO_2$ being compressed from the $CO_2$ supply 76 before it reaches the slurry tank 40.

After exiting the heat exchanger 82 the volume of the slurry being transported in the slurry transport line 62 increases. Generally, the volume of the $CO_2$ increases up to about 1.3 times the volume it had before entering the heat exchanger 82 (the coal volume remaining constant). The slurry is then transported to the fluid/solid separator 64 to remove the excess $CO_2$ from the slurry. The fluid/solid separator 64 removes the excess $CO_2$ to increase the efficiency of the high pressure reactor 72. Moreover, the fluid/solid separator 64 allows for recycling of a substantial portion of the $CO_2$ in the system 10. Generally, about 20% or more of the $CO_2$ pumped through the pump 52 can be recovered in the fluid/solid separator 64. The slurry of the solid coal 11 and the remaining $CO_2$ carrier fluid is moved to the high pressure tank 68 to be further transported to the high pressure reactor 72.

The fluid $CO_2$ removed in the fluid/solid separator 64 is transported in the return $CO_2$ transport line 90. As mentioned above, a portion of this pressurized $CO_2$ is transported to the solid coal pump $CO_2$ supply line 24 to assist in the pumping of the solid coal 11 from the silo 12 to the slurry tank 40. The remaining $CO_2$ is delivered to the expansion valve 92 to first decrease the pressure of the $CO_2$ to the pressure of the slurry tank 40. That is, the pressure of the $CO_2$ drops very quickly from the pumped pressure, which is between about 1100 psig and 1500 psig, to the range of the pressure of the slurry tank 40, which is generally between about 70 psig and about 180 psig. This sudden drop in pressure converts approximately 50 to about 60 weight percent of the $CO_2$ to the gas phase. This combination is transported through the line 94 to the gas/liquid separator 96 so that the liquid portion of the $CO_2$, can be separated and transported to the slurry tank 40. The gaseous portion is transported to the refrigeration condenser 86 to be condensed to a liquid.

The $CO_2$ from the $CO_2$ supply 76 is also pumped to the refrigeration condenser 86 to be cooled to the temperature of the slurry tank 40. The first compressor 80 and the second compressor 84 also raise the pressure of the $CO_2$ from the $CO_2$ supply 76 to the pressure of the slurry tank 40. Then the refrigeration condenser cools it to the temperature of the slurry tank 40. The two gaseous supplies of $CO_2$ are then provided to the slurry tank 40 after being cooled and condensed to a liquid to form the slurry with the solid coal in the slurry tank 40.

Although the solid coal pump 22 provides a continuous feed of solid coal into the pressure system 10, the plurality of valves provided in the system 10 allow for control of the feed depending upon the selected requirements of the system. The expansion valve 92 can serve to control the flow of the coal to the high pressure reactor 72. Movement of the expansion valve 92 can rapidly lower and raise the pressure of the feeder tank 68 to cause rapid changes in the flow rates of the pressurized coal slurry in the feeder tank 68. Furthermore, the isolation ball valve 69 is provided on the line from the feeder line 68 to the high pressure reactor 72. Therefore, an instantaneous stopping or starting of the flow of the coal slurry from the feeder tank 68 can be obtained. The $CO_2$ supply valve 26 can instantaneously control the flow of $CO_2$ to the solid coal pump 22 while the control valve 38 can instantaneously control the flow of coal to the slurry tank 40.

Therefore, the system 10 allows for a continuous supply of pressurized coal to the high pressure reactor 72, rather than requiring intermittent pressurizations and releases of coal from conventional lock hopper pump systems to pump a dry component. The slurry format provides for easy pumping of the ambient pressure coal 11 from the coal silo 12 to the high pressure feeder tank 68.

Figure 2A:
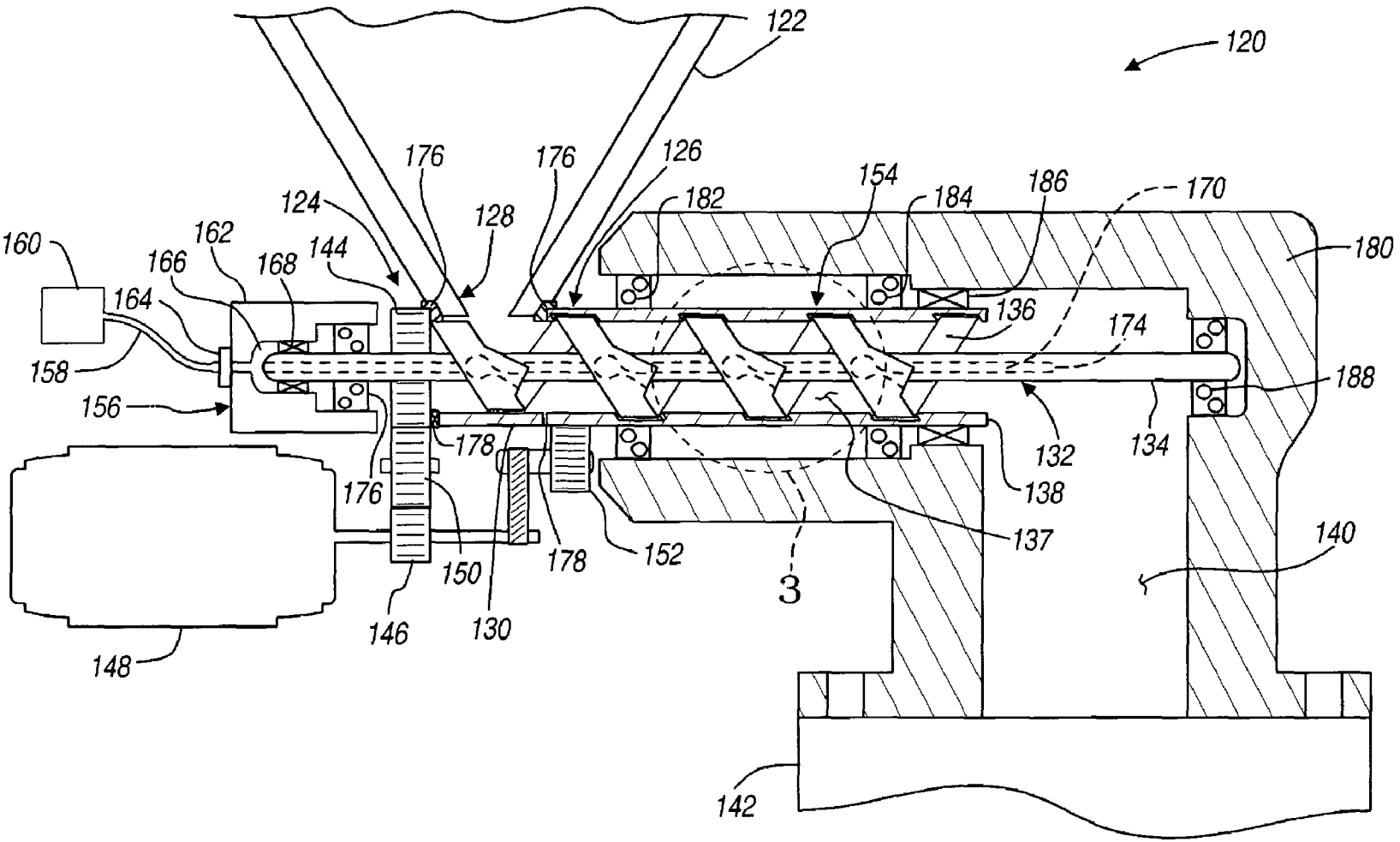
FIG. 2*a* is a simplified cross-sectional view of a jet feeder according to a second embodiment of the present invention.
Figure 2B:
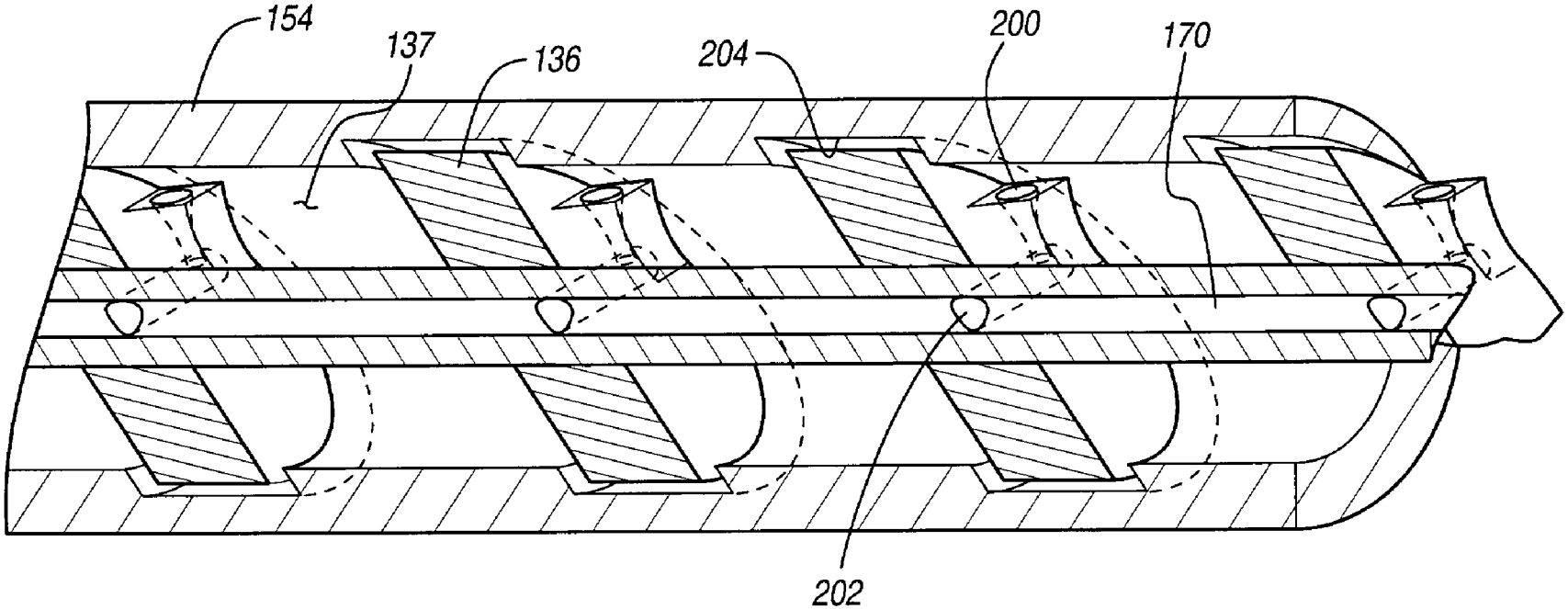
FIG. 2*b* is a detailed cross section perspective view of the screw portion of the screw jet feeder of FIG. 2*a;*

With reference to FIGS. 2 and 2*a*, a pressurized or jet screw feeder 120, which may be used as the solid coal pump 22, is illustrated. The screw jet feeder 120 interconnects or pressurizes solid coal particles which are stored in a coal silo 122. It will be understood that the screw jet feeder 120 may also be used to pressurize other solid materials besides coal. The coal silo 122 generally includes substantially pulverized coal wherein about 70% to about 90% of the coal passes through a 200 mesh. Moreover, the coal silo 122 is generally held at ambient conditions, therefore it has a pressure of about one atmosphere and a temperature of about 21° C.

The coal from the coal silo 122 is also generally gravity fed into a low pressure end 124 of a screw jet barrel 126. The low pressure end 124 of the screw jet barrel 126 includes a feed sleeve 128 of the silo 122. The remainder of the low pressure end 124 of the screw jet barrel 126 is defined by a stationary sleeve 130 which substantially surrounds and seals the remainder of the low pressure portion 124. Turning within the barrel 126 is a screw 132 generally including a central shaft 134 and a screw thread or plane 136 surrounding the shaft 134. Between each turn of the thread 136 is defined a thread space 137 where material is held and moved. The coal from the coal silo 122 is driven from the low pressure end 124 to a high pressure end 138 where the coal is able to drop down the conduit 140 into a high pressure container 142. The pressure of the high pressure container 142 is higher than the pressure of the low pressure end 124 or the pressure of the coal silo 122.

The coal is moved from the low pressure end 124 to the high pressure end 138 by the movement of the screw 132. The movement of a material using a screw conveyor in an equal pressure environment is generally known and will not be described in great detail herein. Nevertheless, the screw jet feeder 120 is able to move the coal from the coal silo 122 to a high pressure container 142 with relative ease.

The screw 132 is rotated through an interconnection of a screw gear 144 and a drive gear 146. The drive gear 146 is driven by a drive motor 148. The drive motor 148 may be any appropriate motor that may be powered by electricity or other fuels. An interconnecting gear 150 allows the direction of the rotation of the drive gear 146 to be the same as the screw gear 144. The drive motor 148 also drives a second or sleeve drive gear 152 which interconnects with splines formed on the exterior of a rotating sleeve 154. The drive motor 148 therefore directly drives the rotating sleeve 154 while it drives the screw 132 with the interconnecting gear 150. Therefore, the screw 132 rotates in a direction opposite the angular rotation of the rotating sleeve 154. When geared correctly, this allows the screw 132 to rotate substantially freely relative to the rotating sleeve 154 even if the screw 132 interacts with the rotating sleeve 154, as discussed further herein.

Near the low pressure end 124 is a $CO_2$ or gas delivery mechanism 156. The gas delivery mechanism 156 delivers a gas through a gas feed line 158 from a gas supply 160. The gas from the gas supply 160 may be any suitable gas, but in one form comprises gaseous $CO_2$, especially when coal is the material that is being moved with the screw jet feeder 120. The gas feed line 158 enters a housing 162 through a sealant nipple 164. Within the housing is defined a sealed space 166 which is defined by the housing and a seal 168. Once the gas fills the gas space 166, it is forced down a bore 170 defined within the shaft 134 of the screw 132. Although the bore 170 is defined substantially as the center of the shaft 134, it will be understood that the bore 170 may be positioned radially on the shaft 134. The bore allows the gas from the gas supply 160 to be provided to any portion of the screw 132. It will be understood that the bore 170 may be defined along the entire length of the shaft 134 or may only be defined to a stopping point 174 to limit the volume of gas required to fill the bore 170.

Also formed within the housing 162 is a first or housing bearing 176. The housing bearing 176 allows the shaft 134 to rotate substantially freely. In addition, the seal 168 allows the shaft 134 to also rotate within the seal 168 while maintaining the sealed gaseous space 166.

Between the housing 162 and the screw gear 144 there does not need to be a substantial seal. Although it may be desired to include tight tolerances to ensure a smooth operation of the screw jet feeder 120, there are no leakages of either coal from the coal silo 122 or gas from the housing 162 which may occur between the housing and the screw drive gear 144. It may be desirable, however, to provide a very tight tolerance or seal to seal the coal silo 122 with the bore 126 of the screw jet feeder 120. Either tight tolerances or a silo seal 176 may be provided between appropriate portions of the silo 122 and the barrel 126. It will also be understood that although the coal silo 122 is illustrated to be in contact with both the rotating sleeve 154 and the screw gear 144, it does not necessarily need to be in contact with these moving parts. It will also be understood that appropriate designs may be included in the present invention which provide that the coal silo 122 be in contact with stationary portions of the screw jet feeder 120 and provide a seal therebetween. In addition, the areas between the stationary sleeve 130 and both the screw gear 144 and the rotating sleeve 154 are also sealed with an appropriate seal member 178. Therefore, material being dropped into the low pressure end 124 of the barrel 126 is not able to fall through the barrel 126 and escape along the screw to possibly interfere with the mechanism of the screw jet feeder 120. Instead, any such material is kept within the barrel 126 itself.

Surrounding the high pressure end and the rotating sleeve 154 is a housing 180. The housing 180 is generally immobile relative the rotating sleeve 154. Therefore, a first sleeve bearing 182 and a second sleeve bearing 184 are provided to allow a substantially easy rotation of the rotating sleeve 154 relative to the housing 180. Also, a seal member 186 is provided between the rotating sleeve 154 and the high pressure conduit 140. This is because the high pressure conduit 140 is at a pressure higher than the area surrounding the rotating sleeve 154, which may be sealed or open to ambient conditions. Therefore, to reduce the possibility or eliminate material blow back into other areas of the screw jet feeder 120, the seal 186 is provided. The seal 186 is adapted to allow substantially free rotation of the rotating sleeve 154 regardless of the seal's 186 presence. In addition, a second shaft bearing 188 is provided to receive the second end of the shaft 134. Therefore, the housing or first bearing 176 and the second bearing 188 substantially hold the shaft 134 in a selected position while allowing its substantially free rotation powered by the drive motor 148.

The coal from the silo 122 is moved from the low pressure end 124 to the high pressure end 138 by the motion of the thread 136 of the screw 132. As the screw 132 rotates, the motion of the thread 136 moves the coal from the low pressure end 124 to the high pressure end 138 because the screw 132 remains stationary. As the coal moves from the low pressure end 124 to the high pressure end 138, compressive forces at the interfaces of touching coal particles are increased along with the gas density within the interstices of the coal particles. Without adding additional gas into the screw feeder's 120 threaded space 137 via nozzles 200, increased gas density will be developed by back flowing high pressure gas from the high pressure conduit 140 into threaded space 137. This back flowing gas will further increase the compressive forces acting at the interfaces of the touching coal particles. Eventually, these interface compressive forces will stop the flow of coal particles through the feeder 120. When this occurs, the screw 132 and the compacted coal will simply rotate as a solid cylinder rather than moving from the low pressure end 124 and ejecting it out the high pressure end 138.

Figure 4:
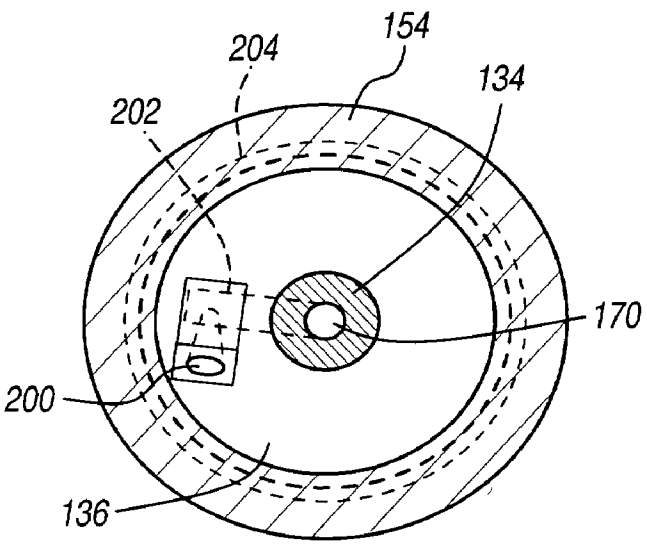
FIG. 4 is a cross-sectional view taken along line 4-4 of FIG. 3.
Figure 3:
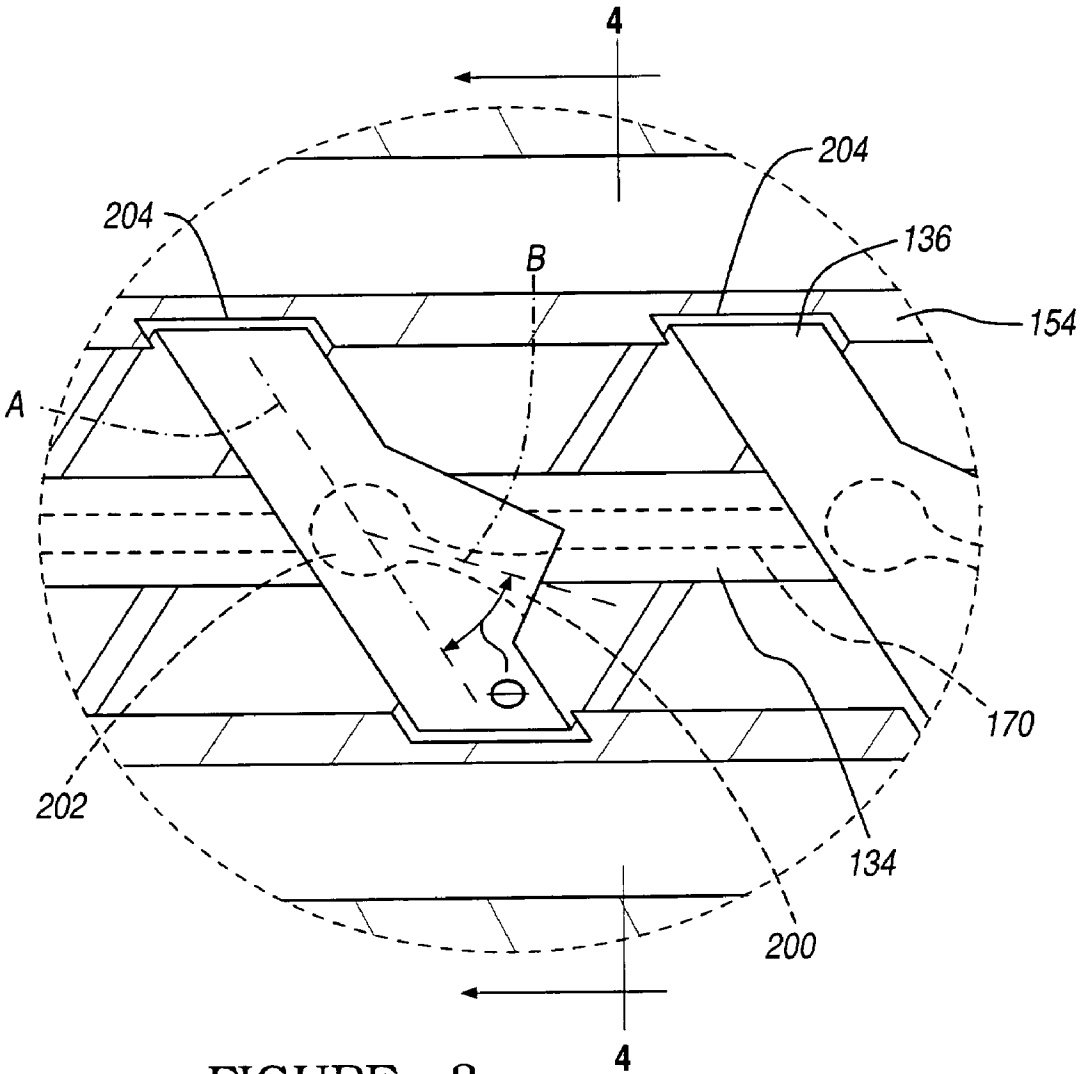
FIG. 3*a* is a detailed view of a portion of the jet feeder from circle 3 of FIG. 2.

To minimize the possibility of the coal being compacted by compressive forces into a single solid plug, the shaft 134 defines the bore 170 through which a gas may be pumped. The gas from the gas supply 160 is provided to the bore 170. With reference to FIGS. 3 and 4, the gas provided through the bore 170 is then ejected out a gas nozzle 200 formed in the threads 136 of the screw 132. The thread 136 defines a plane A. The nozzle 200 is formed about a central axis B and the axis B is formed at an angle $\alpha$ from the plane A of the thread 136. Angle $\theta$ may be any appropriate angle to move the material along the rotating sleeve 154 but is generally about 15° to about 30°. The angle $\theta$ is generally acute relative to the direction of rotation of the screw 132. The gas is provided along the bore 170 at a high pressure. Although the pressure may be regulated and selected if the screw jet feeder 120 is included in the system 10, the pressure provided to the bore is preferably approximately 1300 psig. Therefore, the gas would flow through the bore 170 into a nozzle bore 202 and then be ejected at sonic or just above sonic conditions, generally about mach 1.0 to about mach 1.5, out of the nozzle 200.

The rotating sleeve 154 includes a female notch groove 204 to receive the thread 136 of the screw 132. The groove 204 may be formed in the rotating sleeve 154 to substantially cooperate with the helical shape of the thread 136. Therefore, as the rotating sleeve 154 rotates in a first direction, and the threads 136 of the screw 132 rotate in a second direction, the screw 132 is able to rotate freely within the rotating sleeve 154. This provides a labyrinth seal between the screw 132 and the rotating sleeve 154. Therefore, the material provided in the screw spaces 137 and the gas ejected out of the nozzle 200 is not able to move towards the low pressure end 124 of the tube 126, but rather is always directed towards the high pressure end 138 due to the motion of the screw 132.

The angle $\theta$ of the nozzles relative the plane A of the threads 136 allows for a substantially continuous directional movement of the coal within the thread spaces 137. The nozzle 200 is generally aimed in the rotational direction of the thread 136. Therefore, the supersonic jet of gas being emitted by the nozzle 200 substantially forces the coal in the thread spaces 137 towards the high pressure end 138. Not only does the gas ejected from the nozzle 200 provide additional momentum to the coal within the thread spaces 137 to ensure that the material does not agglomerate or become a solid mass, but the gas ejected from the nozzle 200 also helps counteract the compressive forces within the coal. Because the pulverized coal includes gases in the interstitial spaces, between the individual particles of the coal material these gases become compressed as the coal is forced toward the outlet 138. Therefore, the inclusion of a volume of gas ejected through the nozzle 200 accommodates the compression of the initial volume of interstitial gas by providing a make-up volume of gas. Therefore, even though the coal is moved towards a high pressure head, the introduction of additional gas through the nozzle 200 allows the compression of the original interstitial gases.

Although the rotational speed of the screw 132 may depend upon the material from which the screw 132 is formed, it may generally be formed of a hardened steel. It will also be understood, however, that the screw 132 may be formed of other appropriate materials such as other alloys or titanium alloys. If the screw 132 is formed of a hardened steel, it is generally rotated about 3500 to about 9500 rpm. This provides a tip speed of below about 200 feet per second. When coal is the material being moved with the screw 132, keeping the speed of the screw 132 below about 61 meters per second (about 200 feet per second) ensures that no substantial erosion or corrosion of the screw 132 occurs. Furthermore, the screw 132 may be any appropriate diameter, but is generally about one inch to about five inches in diameter. This provides the ability to move at least about 50 kilograms per second out the high pressure side 138.

The high pressure $CO_2$ generally exit the nozzles 200 at or just above the sonic speed in the range of up to about mach 2.0 or more. This provides a substantial force against the coal becoming fixed in any one position within the thread space 137. Therefore, the material is free to be forced along by the rotational movement of the screw 132 towards the high pressure end 138. Moreover, the high pressure gas will generally be at a temperature of about 10° C. to about 21° C. (about 50° F. to about 70° F.) therefore providing a pre-cooling of the coal within the screw 132 as it expands through nozzles 200. It will be understood that other gases may be used which do not provide such a pre-cooling. Nevertheless, if $CO_2$ is used, a pre-cooling effect will occur. This also helps when the screw jet feeder 120 is being used with the system 10. Because the slurry tank 40 is kept at a temperature about −40° C. to about −57° C. (about minus 40° F. to about minus 70° F.), pre-cooling the coal before it enters the slurry tank 40 reduces the amount of energy required to keep the slurry tank 40 at the required temperatures.

Therefore, the system 10 provides a way to continuously feed coal to the high pressure coal storage tank 68. This eliminates the need to use less effective systems to pressurize coal for the high pressure reactor 72. Moreover, the screw jet feeder 120 provides an efficient way to move atmospheric pressure coal material to the slurry tank 40.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A method for continuously providing pressurized slurry of a solid material and a liquid to a high pressure system, the method comprising:

providing a mechanical feeder to move the solid material;

sonically jetting a fluid within the mechanical feeder against the solid material; and transporting an amount of the material being held at ambient pressure to a pressurized mixing container in connection with the mechanical feeder;

mixing the material in the pressurized mixing container with the liquid to form a slurry;

pumping the slurry to a high-pressure tank from the pressurized mixing container;

removing a portion of the liquid from the slurry before the slurry enters the high-pressure tank.

2. The method of claim 1, further comprising:

providing a first portion of the removed liquid to the mechanical feeder; and providing a second portion of the removed liquid to the high-pressure tank.

3. The method of claim 2, wherein providing the first portion of the removed liquid to the mechanical feeder includes:

maintaining a high pressure of the liquid;

forming a jet of the fluid within the mechanical feeder using the first portion of the removed liquid; and wherein forming the jet assists in providing for a lost volume of an initial volume of a gas trapped within the interstices of a solid material.

4. The method of claim 1, wherein transporting an amount of the solid material with the mechanical feeder includes:

pressurizing the pressurized mixing container to at least five times the pressure of ambient;

transporting in a substantially continuous manner the solid material as a solid particle from the ambient pressure to the pressurized mixing container; and providing for lost volume of the initial gas within the material.

5. The method of claim 1, wherein mixing the solid material in the pressurized mixing container with the liquid to form a slurry includes:

providing the liquid in the pressurized mixing container;

agitating the solid material with the liquid to form the slurry; and cooling the pressurized mixing container to control the pressure of the pressurized mixing container.

6. The method of claim 1, wherein removing a portion of the liquid from the slurry includes:

increasing a temperature of the slurry above a temperature of the slurry in the pressurized mixing container;

separating an excess portion of the liquid from the slurry; and wherein the volume of the slurry increases after its temperature is increased.

7. A method to substantially continuously provide a pressurized coal slurry to a pressurized holding tank, the method comprising:

providing substantially continuously coal at an ambient pressure to a feeder having a feeder inlet;

moving the coal from with the feeder to a slurry tank to hold a slurry of the coal and a liquid at a pressure of at least about 65 psig; and moving the slurry from the slurry tank to a high pressure tank, wherein the high pressure tank is at a pressure at least four times greater than that of the slurry tank.

8. The method of claim 7, further comprising:

heating the slurry as the slurry travels from the slurry tank to the high pressure tank.

9. The method of claim 8, further comprising:

mixing the coal and a slurry agent to form the coal slurry;

moving the slurry agent through a heat exchanger such that a portion of the slurry agent is cooled and the slurry is warmed.

10. A method to substantially continuously provide a pressurized coal slurry to a pressurized holding tank, the method comprising:

providing substantially continuously coal at an ambient pressure to a feeder having a feeder inlet;

moving the coal from with the feeder to a slurry tank to hold a slurry of the coal and a liquid at a pressure of at least about 65 psig; and moving the slurry from the slurry tank to a high pressure tank, wherein the high pressure tank is at a pressure at least four times greater than that of the slurry tank;

heating the slurry as the slurry travels from the slurry tank to the high pressure tank;

mixing the coal and a slurry agent to form the coal slurry;

moving the slurry agent through a heat exchanger such that a portion of the slurry agent is cooled and the slurry is warmed;

removing an excess portion of the slurry agent after the slurry has passed through the heat exchanger;

recycling the excess portion of the slurry agent; and maintaining a selected pressure.

11. A method to substantially continuously provide a pressurized coal slurry to a pressurized holding tank, the method comprising:

providing substantially continuously coal at an ambient pressure to a feeder having a feeder inlet;

moving the coal from with the feeder to a slurry tank to hold a slurry of the coal and a liquid at a pressure of at least about 65 psig; and moving the slurry from the slurry tank to a high pressure tank, wherein the high pressure tank is at a pressure at least four times greater than that of the slurry tank;

heating the slurry as the slurry travels from the slurry tank to the high pressure tank;

mixing the coal and a slurry agent to form the coal slurry;

moving the slurry agent through a heat exchanger such that a portion of the slurry agent is cooled and the slurry is warmed;

wherein mixing the coal and a slurry agent includes mixing carbon dioxide with the coal.

12. A method to substantially continuously provide a pressurized coal slurry to a pressurized holding tank, comprising:

providing substantially continuously coal at an ambient pressure to a feeder having a feeder inlet;

moving the coal from with the feeder to a slurry tank to hold a slurry of the coal and a liquid at a pressure of at least about 65 psig; and moving the slurry from the slurry tank to a high pressure tank, wherein the high pressure tank is at a pressure at least four times greater than that of the slurry tank, wherein the pressure of the slurry tank is about 65 psig to about 160 psig, and wherein the pressure of the high pressure tank is about 1100 psig to about 1500 psig.

13. A method to substantially continuously pressurize a solid material for assisting in feeding the material into a pressure reaction, the method comprising:

supplying the solid material at a first pressure to a feeder from a container;

feeding the solid material to a tank at a second pressure of at least about 65 psig;

pumping the solid material from the tank to a high pressure tank through a line;

heating the solid material as the material travels from the tank to the high pressure tank;

wherein said second pressure is at least twice the level of said first pressure;

wherein said feeder selectively and substantially continuously transports the solid material from said container to said tank;

wherein a pressure within said high pressure tank is substantially greater than the pressure of said tank.

14. The method of claim 13, further comprising:

providing a slurry agent to said tank;

associating a slurry agent supply with said heat exchanger;

forming a slurry at least in part by mixing a portion of said providing slurry agent said solid material; and wherein heating the solid material includes moving said formed slurry through a heat exchanger to transfer thermal energy from said slurry agent to said slurry to cool a portion of the slurry agent a first amount and to warm the slurry a second amount.

15. The method of claim 14, further comprising:

substantially maintaining the pressure of the slurry and removing an excess portion of the slurry agent after the slurry has passed through said heat exchanger; and returning the excess portion of the slurry agent to said tank.

16. The method of claim 15, further comprising:

providing a condenser;

moving the excess portion of slurry agent through the condenser;

condensing the slurry agent to a liquid; and supplying the condensed slurry agent to the tank.

17. The method of claim 7, further comprising:

ejecting a jet of the fluid within the mechanical feeder at a velocity of at least mock one.

18. The method of claim 1, wherein the jetting includes ejecting the fluid at a speed of mock one or greater.

19. The method of claim 1, further comprising:

jetting the fluid from a screw within the mechanical feeder.

20. The method of claim 19, further comprising:

ejecting the fluid from a nozzle of a thread of the screw.

21. The method of claim 20, further comprising:

transporting the fluid through an internal bore within the screw to the nozzle.

22. The method of claim 7, further comprising:

moving the coal from the high pressure tank to a high pressure reactor.

* * * * *